US009171708B1

(12) United States Patent
Doroshenko et al.

(10) Patent No.: US 9,171,708 B1
(45) Date of Patent: Oct. 27, 2015

(54) AMBIENT PRESSURE IONIZATION SOURCE USING A LASER WITH HIGH SPATIAL RESOLUTION

(71) Applicant: Science and Engineering Services, LLC, Columbia, MD (US)

(72) Inventors: Vladimir M. Doroshenko, Sykesville, MD (US); Victor V. Laiko, Columbia, MD (US); Eugene Moskovets, Columbia, MD (US)

(73) Assignee: Science and Engineering Services, LLC, Columbia, MD (US)

( * ) Notice: Subject to any disclaimer, the term of this patent is extended or adjusted under 35 U.S.C. 154(b) by 0 days.

(21) Appl. No.: 14/606,495

(22) Filed: Jan. 27, 2015

(51) Int. Cl.
*H01J 49/16* (2006.01)
*H01J 49/26* (2006.01)
*H01J 49/04* (2006.01)

(52) U.S. Cl.
CPC ..... *H01J 49/161* (2013.01); *H01J 49/0404* (2013.01); *H01J 49/164* (2013.01)

(58) Field of Classification Search
CPC ... H01J 49/0404; H01J 49/0013; H01J 49/16; H01J 49/164; H01J 49/26
USPC ..... 250/423 P, 423 R, 281, 282, 283, 288, 250/289
See application file for complete search history.

(56) References Cited

U.S. PATENT DOCUMENTS

| | | | | |
|---|---|---|---|---|
| 7,122,789 | B2 * | 10/2006 | Tan et al. | 250/282 |
| 8,242,440 | B2 * | 8/2012 | Splendore et al. | 250/288 |
| 8,440,965 | B2 * | 5/2013 | Musselman | 250/285 |
| 8,471,199 | B1 * | 6/2013 | Doroshenko et al. | 250/281 |
| 8,525,111 | B1 * | 9/2013 | Brown et al. | 250/289 |

* cited by examiner

*Primary Examiner* — David A Vanore
(74) *Attorney, Agent, or Firm* — Oblon, McClelland, Maier & Neustadt, L.L.P.

(57) ABSTRACT

An interchangeable ion source for a spectrometer. The ion source includes an interface which mounts the ion source relative to a gas inlet of the spectrometer, a sample holder, a laser which produces a laser beam capable of ionizing the sample at ambient pressure, and an optical system. The ion source includes an equipment chassis which supports the interface, the sample holder, the laser and the optical system as a rigid unit such that the interface, the sample holder, the laser and the optical system remain in alignment upon attachment and detachment of the ion source from the spectrometer and an enclosure which embraces an atmosphere around components of the ion source. In addition, the ion source includes a circulator which circulates at least part of the atmosphere within the enclosure.

30 Claims, 4 Drawing Sheets

PRIOR ART

B. Spengler et al., in Proc. 60th ASMS Conf. Mass Spectrom. Allied Topics, Vancouver, BC, Canada, 2012

AMBIENT PRESSURE IONIZATION SOURCE USING A LASER WITH HIGH SPATIAL RESOLUTION

BACKGROUND OF THE INVENTION

1. Field of Invention

This invention is related to mass spectrometry of biological samples. More specifically, this invention is related to the use of ambient pressure matrix-assisted laser desorption/ionization technique in mass spectrometry imaging applications.

2. Discussion of the Background

Ambient pressure (AP—also sometimes referred to as atmospheric pressure) matrix-assisted laser desorption/ionization (MALDI) mass spectrometry (MS) is a standard technique for producing ions from labile molecules, especially biological molecules [see Laiko et al., U.S. Pat. No. 5,965,884; and Bai et al., U.S. Pat. No. 6,849,847, the entire contents of which are incorporated herein by reference]. It is widely used in MS imaging (MSI) applications used for studying spatial distribution of biomolecules in special samples—biological tissues. Typically, the definition of the ambient pressure range includes the pressure from 0.1 Torr to 2,000 Torr.

AP ion sources can utilize different ionization techniques, which in addition to AP-MALDI also include electrospray ionization (ESI), AP chemical ionization (APCI), direct analysis in real time (DART), AP photoionization (APPI), desorption ESI (DESI), secondary ESI (s-ESI) etc. Small molecules can be ionized without a matrix (so-called direct laser ionization or DLI) and also using nanostructure-assisted laser desorption/ionization (NALDI), surface-enhanced laser/desorption ionization (SELDI), or desorption/ionization on silicon (DIOS) techniques. The AP ion sources have been used with mass spectrometers having atmospheric pressure interfaces (API) for the introduction of ions generated at ambient pressure conditions into the vacuum of mass spectrometers. The interchangeability of AP sources (meaning that different AP sources can be attached to the same MS typically within few minutes) and the wealth of ionization techniques available at AP conditions make mass spectrometers with API attractive and widely popular. AP ion sources are also used in ion mobility spectrometry (IMS) separating ions based on different gas phase mobility of ions while the ions are drifting in electric fields.

The requirement of interchangeability in conventional AP-MALDI design usually required an optical fiber for connecting a laser to an AP-MALDI ionization chamber. The laser spot size on the sample in such an AP-MALDI design is usually determined by the diameter of the optical fiber used (typically in the 100-500 μm range).

The subject matters of the patents, patent applications, and articles described herein are all incorporated by reference in their entirety herein.

SUMMARY OF THE INVENTION

In one most preferred embodiment of the present invention, there is provided an interchangeable ion source for a spectrometer. The ion source includes an interface which mounts the ion source relative to a gas inlet of the spectrometer, said inlet having at least one gas inlet opening with a characteristic opening diameter D and an inlet gas flow axis Z, a sample holder which positions a sample in proximity to the at least one gas inlet opening, an electric voltage supply which applies a voltage between the sample holder and the gas inlet of the spectrometer, a laser which produces a laser beam capable of ionizing the sample at ambient pressure, and an optical system including one or more focusing elements which focus said laser beam into a spot of a characteristic spot diameter d on or within said sample. The spot diameter d is smaller than the characteristic opening diameter D of the gas inlet opening, where the ratio d/D is less than 1. The spot has a deviation δ from the inlet axis Z which is smaller than the opening diameter D such that a ratio δ/D is less than 1. The ion source further includes an equipment chassis which supports the interface, the sample holder, the laser and the optical system as a rigid unit such that the interface, the sample holder, the laser and the optical system remain in alignment upon attachment and detachment of the ion source from the spectrometer, an enclosure which embraces an atmosphere around at least part of the interface, at least part of the sample holder, at least part of the optical system, at least part of the laser and at least part of the chassis; and a circulator which circulates at least part of the atmosphere within the enclosure.

It is to be understood that both the foregoing general description of the invention and the following detailed description are exemplary, but are not restrictive of the invention.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
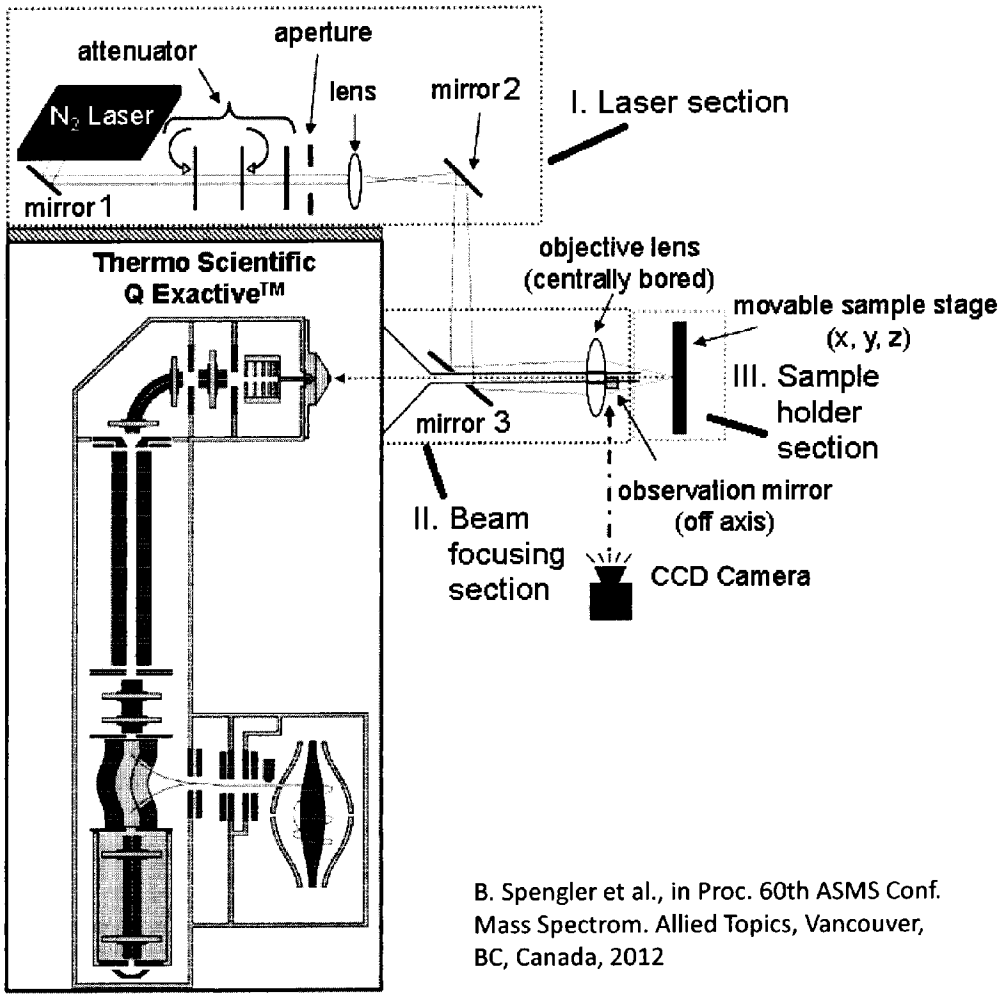
FIG. 1 is a prior art system of an ambient pressure ion source with a direct laser coupling optical scheme.

MS imaging (MSI) of biological samples (like tissues) would benefit from higher spatial resolution of AP MALDI analysis as this allows observing smaller objects in the sample down to a single cell analysis. Currently, 50-500 μm spatial resolution is typically obtained using the AP-MALDI design with optical fibers (discussed above). Meanwhile, 5-10 μm spatial resolution has been demonstrated using direct laser coupling scheme (without fibers). However, because of large size and dimensions used in the demonstrated direct laser coupling AP-MALDI design [see, for example: B. Spengler et al. "High Resolution in Mass and Space: AP-MALDI Imaging Using Orbitrap-based Instrumentation", in Proc. 60$^{th}$ ASMS Conf. Mass Spectrom. Allied Topics, Vancouver, BC, Canada, 2012] the mechanical and thermal stability of the laser spot is problematic and cannot be sustainable for a long period of time typically required in MSI, making imaging unreliable. In addition, the capability of interchangeability of AP sources is lost in such large designs.

Having even smaller laser spots (less than 1-5 μm) is highly desirable for imaging and other applications. Such small laser spots can be obtained using the direct laser coupling method. However, the requirements for stability of the laser optical and ion-optical design at such small laser spots are especially difficult to achieve as the MSI experiments typically take many hours or even days (depending on number of pixels in the MS image) where any small thermal and mechanical instability may bring substantial laser spot size and position deviations over the time resulting in image quality corruption (i.e., inaccurate pixel position and/or intensity).

This invention is related to the design of AP-MALDI ion sources having stable laser optical and ion-optical temporal behavior in which the capability of interchangeability of AP sources is realizable.

Thermal and mechanical stability of the AP-MALDI source design and operation is an important attribute for imaging mass spectroscopy. This invention addresses two sources of stability: laser spot stability and ion-optical stability. To achieve a high spatial resolution (<5-10 μm laser spot) using UV ablation with pulsed nanosecond lasers as in MALDI MS imaging, it is desirable (perhaps even necessary) to utilize a spatially-optimized laser beam profile. For example, the optical intensity beam profile within the laser spot produced on a sample spot by focusing using a low-divergent laser beam should be stable for hours to provide one and the same conditions for laser ablation. While variations of laser power in UV laser utilizing 3rd harmonics of diode pumped Nd-YAG lasers can be stabilized with few percent, spot size stabilization needs to be preferably kept within the same level of stability. This requirement means that positions of diode-pumped solid state (DPSS) laser crystals and elements of optical system including an out-coupling laser mirror, lenses, and mirrors (which altogether provide delivery of laser beam to form a small focusing spot on a sample) need to be stable within the time period of a sample scan, typically a few hours.

The MALDI process is characterized by a very strong dependence of the ion signal on the power density P ($W/m^2$). Studies on UV MALDI have shown that ion yield "I" (the number of ions per laser pulse) depends on laser power density as $I=kP^6$ where the coefficient k depends on matrix material. Therefore, variations in spot size even when the total laser energy is constant can produce uncontrollable variations in ion signal due to changes in power density. Thereby, elimination of even small variations in laser spot size, and consequently, stabilization of ion yield from the sample, can positively affect the quality of MALDI images from biological substrates.

In the background art [B. Spengler, A. Römpp, S. Günther, O. Schulz, K.-P. Hinz, A. Hester, C. Schinz, C. Lotze, J.-U. Pötzl, K. Strupat, "High Resolution in Mass and Space: AP-MALDI Imaging Using Orbitrap-based Instrumentation", in Proc. 60$^{th}$ ASMS Conf. Mass Spectrom. Allied Topics, Vancouver, BC, Canada, 2012], three subsystems in an AP-MALDI ion source (namely, laser, optical beam delivery, and sample positioning systems) are loosely bound as they do not use a single mechanically robust platform. The laser with a part of the optical beam delivery system was located in one mechanically separate enclosure while the other part of the optical system with the sample holder and positioning system was located in the second separate enclosure (see FIG. 1). The first enclosure was placed on the top of a mass spectrometer cover and the second enclosure was mechanically attached to the MS inlet. To protect personnel, the laser beam generated inside of the first enclosure is directed to the second enclosure via thin-wall tubing. The distances between the mirror and lenses were on the order of 10-50 cm, which made the system vulnerable to the effects of temperature gradients.

Therefore, any changes in the room temperature would have caused a mechanical stress in the elements of optical system and change in relative positions of the laser out-coupling mirror and focusing lenses resulting in a walkout of the laser beam. This walkout even if its small (a few tens of a micron) would nevertheless have caused a change in the direction of the laser beam and/or change of laser beam alignment with respect to the lens center. One consequence of the walkout is an uncontrollable deviation of the laser spot from the predetermined scan path (a typical scanning pattern is a series parallel straight lines with positioning accuracy of better than 10 μm), while another consequence is the resulting aberrations due to a change in positioning of the laser beam on a surface of one or multiple lenses. To achieve the best focusing condition, the beam center should coincide with the lens center. If the center of laser beam passing through the lens is off the lens' center or if the beam incidence angle when it passes through the lens changes, then the deviant laser spot dimension on a sample will be different due to optical aberrations (e.g., spherical, coma etc). Aberrations also cause a redistribution of laser radiation intensity within the spot.

In one aspect of this invention, both the stabilization of a laser spot position on a sample and the stabilization of spot size and shape are achieved by an embodiment which arranges the three systems into a single, compact, mechanically robust, thermally stable, and relatively lightweight platform that can be attached to a mass spectrometer using a single mechanical interface element (adapter). In addition the interchangeability of the ion source is retained in this design.

To diminish mechanical stress caused by a changing gradient of air temperature in and around the ion source, the platform size is preferably, but not necessarily, compact and the three above-mentioned subsystems are preferably, but not necessarily, as close to each other as possible. A single enclosure is preferably, but not necessarily, used to envelope the three subsystems in order to isolate as much as possible the integrated platform from external condition variations (such as air temperature gradient) and thus to minimize the effects generated by changes in ambient conditions. In addition, to attain high directional stability, the laser, optical system, and sample holder are preferably attached to (or combined by) a single mechanical support element (i.e., an equipment chassis), preferably (but not necessarily) having low thermal expansion coefficient, like invar, special ceramics (calcined alumina), titanium or stainless steel (grade 410).

Modern DPSS lasers generating pulses with a few μJ energy required for high special resolution MALDI MS imaging are compact and can be placed into a small enclosure comparable to the size of typical MALDI imaging sample holder (typically 5×5 cm). In one aspect of the invention, the use of the compact and lightweight optical system that has a minimum number of elements mechanically attached to the same support element as the laser allows one to minimize the beam walkout and defocusing, provided there is thermal stability of those elements. Moreover, the sample holder with a sample positioning system is preferably, but not necessarily, attached to the same platform to assure that the laser focusing spot is robustly positioned with respect to a preselected point on a sample.

Almost all temperature gradient problems come from the mass spectrometer side of the enclosure. The temperature near the MS inlet capillary is typically in the 150-250° C. range, and can be more than 300° C. in some applications. Therefore, once a sample holder with a sample is moved toward the MS inlet after the sample change, the sample holder temperature slowly changes from the room temperature to up to 300° C. during the experiment. The optical elements directing and focusing the laser beam are also subject to being heated. Thus, in one aspect of the invention, the reduction of thermal gradients and even thermal stabilization of sample holder, the optical system and the laser is preferable. When used, the reduction of thermal gradients and even thermal stabilization of sample holder typically can be done within small ion source enclosures with well-circulated and even thermo-stabilized atmosphere inside the ion source enclosure. The air circulation can reduce thermal gradients inside the source multi-fold even at moderate flow rates of few liters per minute. The thermal stabilization of the atmosphere inside the ion source enclosure is especially important if the outside environment temperature is prone to change, like in fieldable instruments.

However, it is well known that, due to the requirement of ion-optical stability, in virtually all commercially-available ion sources no substantial air movement is allowed within the ion source. This is due to the use of a pulse dynamic focusing (PDF) technique for increasing the ion collection of the generated AP-MALDI ions at the gas inlet of mass spectrometer [P. V. Tan, V. V. Laiko, V. M. Doroshenko, "Atmospheric pressure MALDI with pulsed dynamic focusing for high-efficiency transmission of ions into a mass spectrometer", Anal. Chem., 2004, v. 76, 2462-2469].

In PDF sources, the ion motion is controlled by the electric field that pushes the ions toward the MS inlet, but only for a short period of time after the laser pulse (typically for 10-20 μsec). For the rest of the time (typically more than 1 msec), the ions travel to the MS inlet only with assistance of air flowing into MS (because the electric field in the PDF method is tuned off for most of the time). During this travel, ions are susceptible to any air flow perturbation near the irradiated spot on a surface of the AP-MALDI target. For this reason, conventionally it was perceived that any kind of air movement or circulation was not an acceptable solution for decreasing thermal gradients.

The PDF technique has been prominently used with AP-MALDI. The first AP-MALDI experiments [V. V. Laiko, M. A. Baldwin, A. L. Burlingame, "Atmospheric pressure matrix-assisted laser desorption/ionization mass spectrometry", Anal. Chem., 2000, v.72, 652-657] were done without pulse dynamic focusing technique. However, introduction of PDF [P. V. Tan et all., Anal. Chem., 2004, v. 76, 2462-2469] brought a substantial (more than order of the magnitude) improvement in the AP-MALDI sensitivity. Almost all current AP-MALDI platforms utilize PDF by default. Conventionally, the absence of PDF in an AP-MALDI source would be considered a substantial design deficiency resulting in lower sensitivity.

This invention preserves the high sensitivity of AP-MALDI analysis (typically associated with the PDF technique) in a design having an interchangeable high spatial resolution AP-MALDI ion source. This design resolves the two seemingly contradictory requirements: (1) well-circulated atmosphere to achieve low thermal gradient and high laser spot stability, and (2) no air movement in a typical commercial AP-MALDI ion sources to achieve good ion collection efficiency.

The laser fluence threshold for ion generation does not depend on the laser spot size. The smaller laser spot size means that less energy is required per laser pulse with corresponding smaller number of ions generated per the pulse. To retain the same number of ions generated per second, the repetition rate of laser firing is typically increased inversely proportionally to the spot area.

Figure 2:
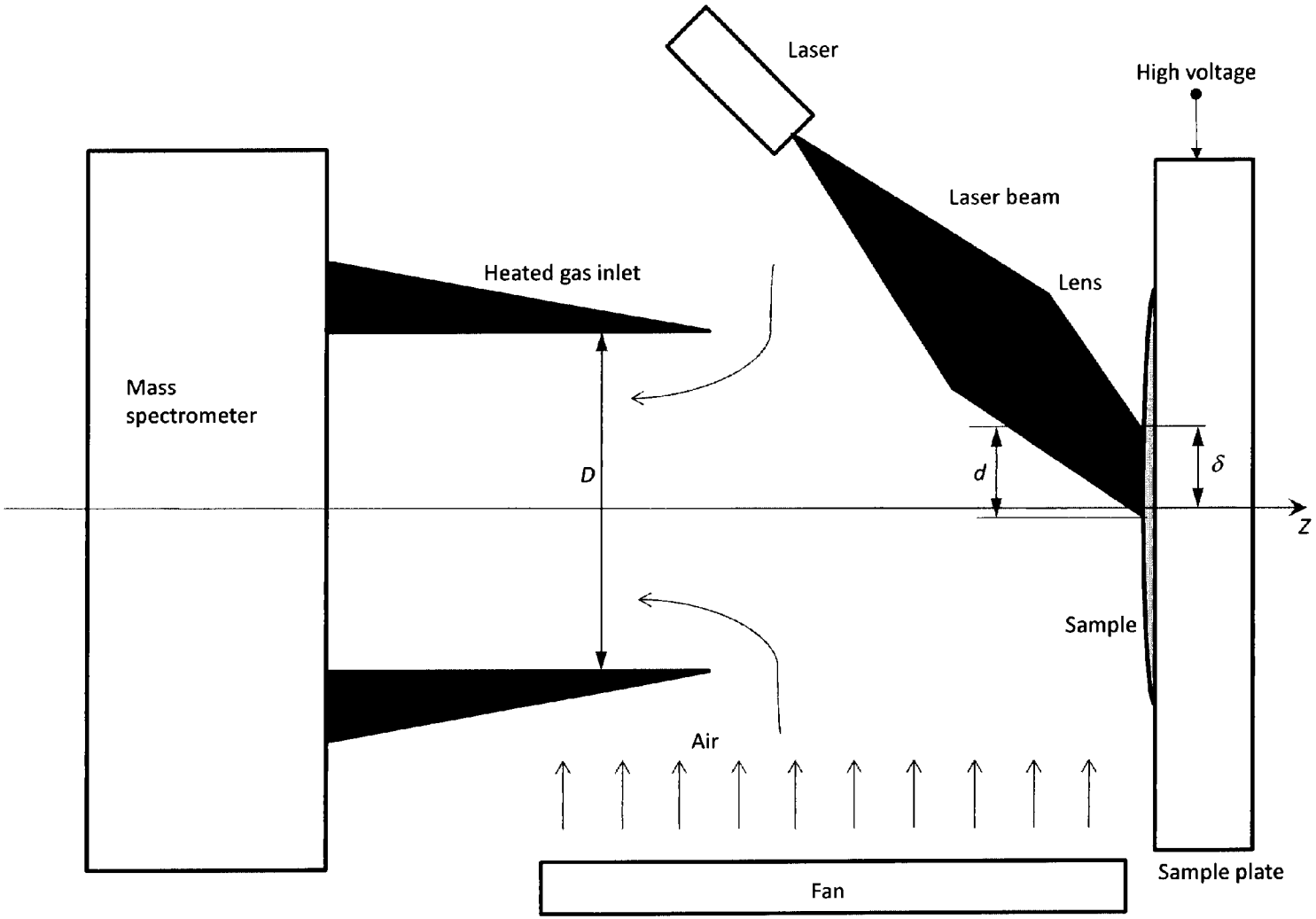
FIG. 2 is a schematic of an ambient pressure MALDI ion source with low thermal gradients inside the source for high spatial and temporal stability of the laser spot.

The inventors have discovered that, at small laser spot diameters d (typically $d/D \ll 1$ where D is diameter of a mass spectrometer inlet opening used for ion introduction into the mass spectrometer) and small deviations δ (typically $\delta/D \ll 1$) from the MS inlet gas flow axis Z (as shown in FIG. 2), the effect of PDF technique is negligible, i.e., the ion signals have about the same intensity when the PDF high voltage pulsing circuitry was on and off. This phenomenon is believed due to the high efficiency of ion collection when the laser spot is small and when its position is adjusted to be on the axis of the MS inlet (i.e., on the axis of the gas inlet flow pattern). This effect was not observed for larger laser spots with diameters d larger or comparable to the MS inlet opening diameter D presumably because those ions originated on the boundary of the lager spot are lost (by hitting an external or internal wall of the inlet capillary) due to drifting by the electric field toward the MS inlet when the high voltage on the sample was not pulsed. Such loss for the larger diameter spots can be significantly reduced by pulsing the PDF high voltage circuitry to turn off the electric field between the sample plate and the MS inlet so the ions are introduced into the MS inlet open channel by the intake air flow instead of drifting by the electric field.

Surprisingly, the inventors observed that the ion signal with high repetition rate (>1000 Hz) laser was even larger (by more than 2 times) when the PDF pulsing circuitry was turned off, compared to the case when PDF was on. This discovery led to understanding that, in high spatial resolution AP-MALDI, one can efficiently introduce the ions into MS without using PDF. Without PDF, the laser and all optical components can be placed within a relatively small enclosure. By utilizing efficient atmosphere ventilation and circulation within the AP-MALDI enclosure, the inventors have found good thermal and mechanical stability in both laser spot size and position for a relatively long temporal period (more than one day). With small laser spots, high sensitivity in a compact and mechanically rigid AP-MALDI design can be maintained in the absence of PDF by precise laser alignment relative to the center of the MS inlet.

In one aspect of the invention, as schematically shown in FIG. 2 (not to scale), possible local heating from MS inlet area coming into internal area of the AP-MALDI source (mainly and firstly to the sample area) is effectively disrupted by the air moving around the MS interface inlet, sample and source optical elements resulting in effective heat removal and substantially less heating and fewer thermal gradients inside the source. The heat is eventually removed with air by forcefully venting the source outside to the surrounding environment. The temperature inside the source can be stabilized by a thermostat of any suitable design controlling the fan or other atmosphere circulator device.

As a result, the inventors have for the first time realized a compact design of an interchangeable AP-MALDI source with direct laser coupling having a high spatial resolution without sacrificing ion sensitivity.

Exemplary and non-limiting embodiments of an ambient pressure MALDI ion source with high spatial and temporal stability of the laser spot according to this invention are described below.

Figure 3:
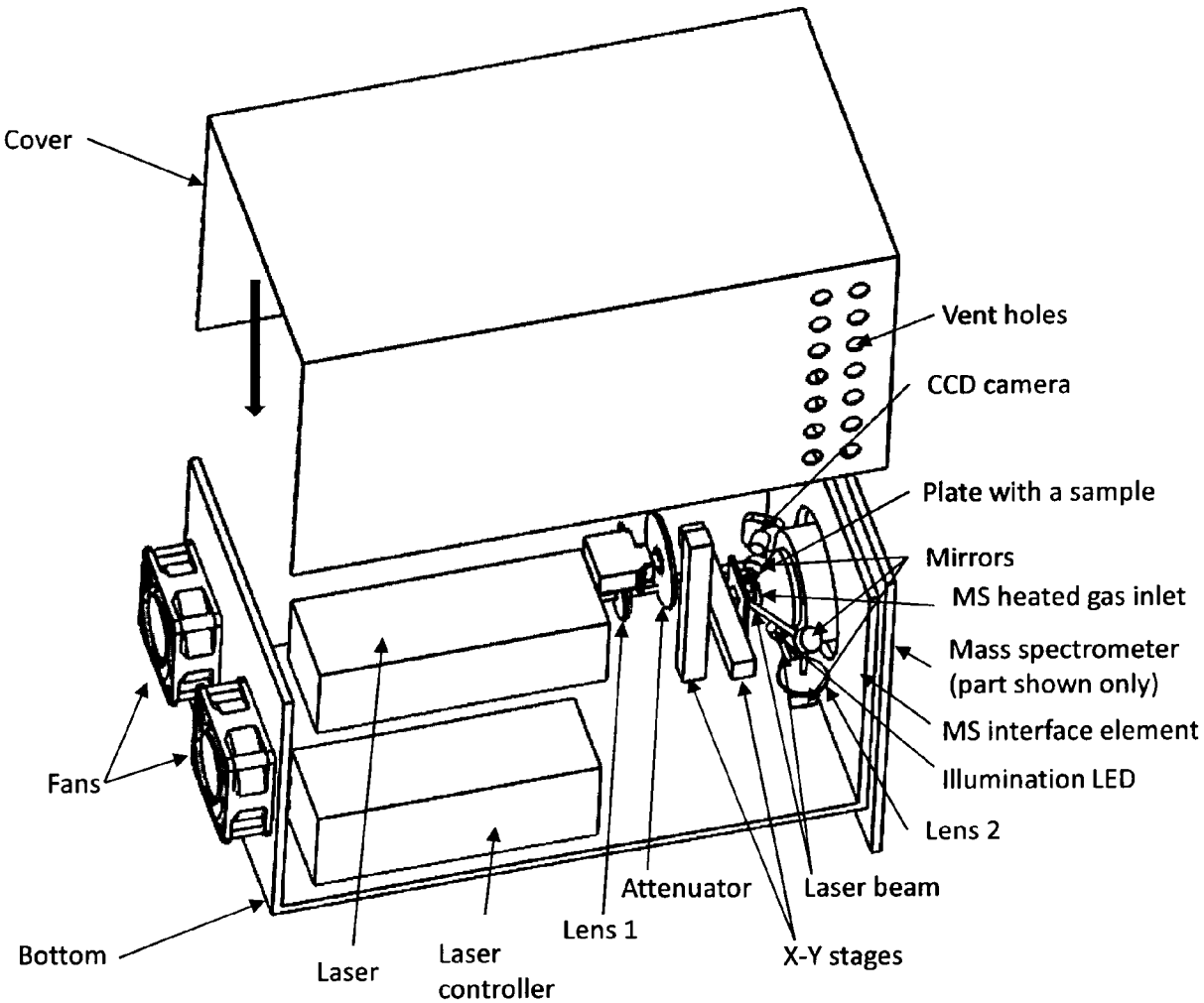
FIG. 3 is a schematic of an interchangeable ion source according to the invention.

The AP-MALDI source enclosure according to one embodiment is shown in FIG. 3. The AP-MALDI source includes a 355 nm laser with its controller (for example, a Diode Pumped Passively Q-Switched Solid State Laser Model FTSS355-Q2 from CryLaS GmbH, Berlin, Germany) located inside an enclosure having a bottom plate (serving as equipment chassis) and cover parts. The laser is bolted directly to the bottom plate.

The optical system includes a first negative lens (e.g., focal length FL=−9 mm) fixed directly to the laser output (not shown in FIG. 3) for spreading the laser beam from 0.2 mm to ca. 8 mm on a second focusing lens, can include an attenuator (for example, a variable neutral density filter part number NDC-50C-2 from Thorlabs, Newton, N.J. put on a shaft of a Hitec 31081 S HS-81 Micro Servomotor), and can include mirrors directing the laser beam to the second focusing lens (FL=50 mm) and further to a sample holder at the incidence angle of e.g., 60° (30° to the sample plate surface). The second lens is fixed on a top of a 6-mm travel stage (not shown in FIG. 3) so its position along the laser beam can be adjusted by the operator to make a tight focus on or inside the sample (in the illustrated embodiment the laser is focused to the spot of about 10 μm size at the distance of about 76 mm from the second lens to the sample). The last mirror is fixed onto a kinematic stage (not shown in FIG. 3) that allows the operator to adjust the laser spot position relative to the MS gas inlet axis Z. The second lens stage and the mirror mounts are firmly fixed to the enclosure bottom plate using mechanical holders (not shown in FIG. 3).

A sample (typically, a 15-μm thick layer of biological tissue covered with a MALDI matrix prepared, for example, as described in: J. A. Hankin, R. M. Barkley, R. C. Murphy, Sublimation as a method of matrix application for mass spectrometric imaging. *J. Am. Soc. Mass Spectrom*. 2007, v. 18, 1646-1652) is held on a stainless steel plate. The sample holder is positioned on a top of computer-controlled crossed X-Y stages (for example, Model USM28-055-NS-1 from US Automation, Laguna Hills, Calif.). The plate is positioned on the inlet axis Z against an opening of the MS gas inlet used for ion introduction to MS (some commercial mass spectrometers have more than one inlet opening) at the distance of about 2 mm and fixed to the bottom plate using a firm mechanical holder (not shown in FIG. 3). The plate is electrically isolated from the enclosure and an electric potential difference (2-3 kV) is continuously applied between the sample plate and the MS inlet to drive ions toward the MS inlet.

The laser spot dimensions and its position relatively the MS gas inlet can be displayed and seen on a computer monitor using a CCD camera located inside the AP-MALDI enclosure. To get the best image quality, the sample is illuminated perpendicularly to the CCD camera vision line by a light-emitting diode (LED). This image is used for precise alignment of the laser spot on the MS inlet axis Z with accuracy generally less than 10 μm (compared to a typical inlet opening diameter of 500-1,000 μm).

The back of the enclosure includes fans (e.g. circulators) for directing cool air from the environment into the AP-MALDI source enclosure. Other types of air circulator can be used such as gas flow from an external air supply line typically available in a lab. Venting holes on the cover sides allows effective air movement around the MS gas inlet and the sample to remove the excessive heat coming from the MS heated gas inlet to outside the source enclosure. Fan and vent hole positions in the AP-MALDI design are set for efficient heat removal from the MS gas inlet area. In another embodiment of the invention shown in FIG. 4 the vent holes are located in a floor of the enclosure. This design provides asymmetrical air flow near the MS inlet capillary allowing efficient removal of the heat coming from the inlet capillary heaters.

Figure 4:
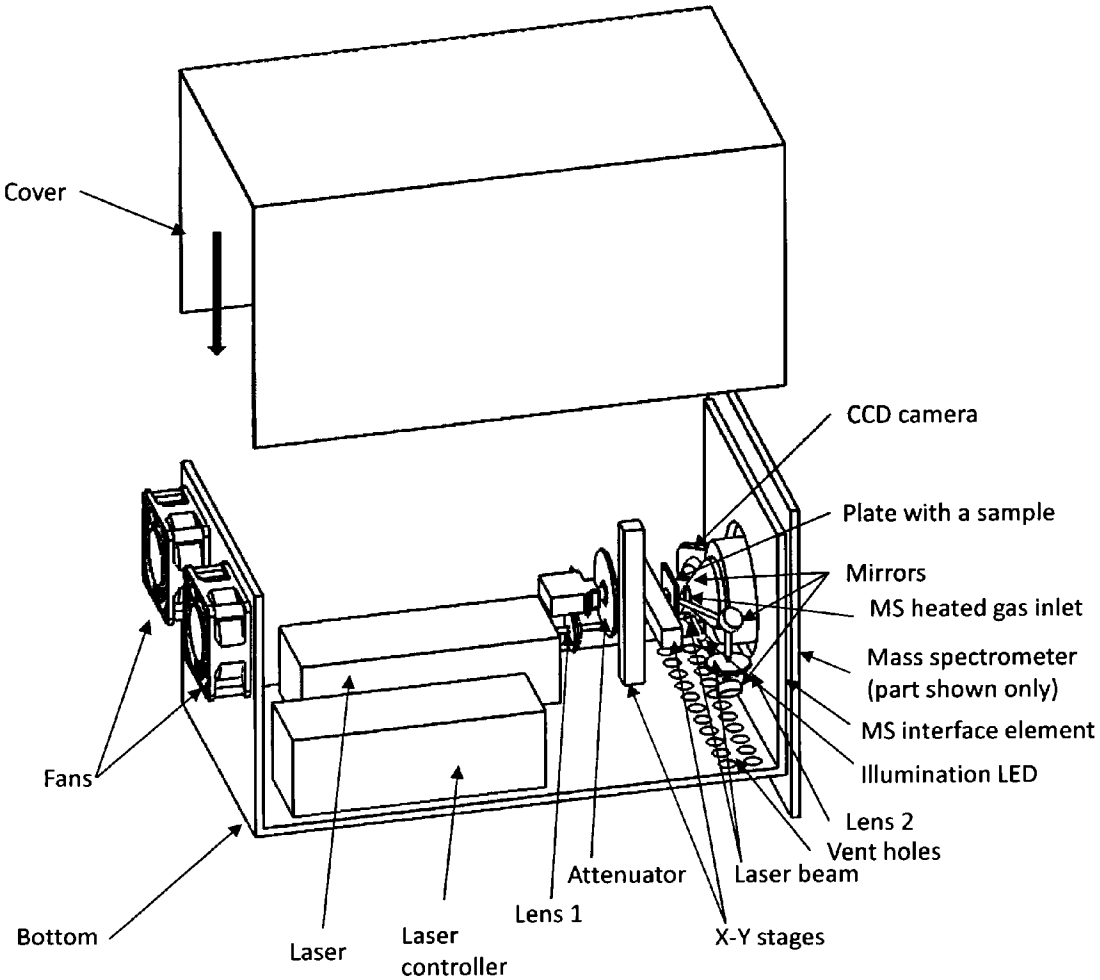
FIG. 4 is a schematic of another embodiment of interchangeable ion source according to the invention with asymmetrical air flow near the MS inlet capillary.

The design shown in FIGS. 3 and 4 permits the placing also of the control electronics inside the AP-MALDI enclosure, where the electronics would be controlled e.g., via an Ethernet RJ-45 interface and powered by a laptop-style DC power supply.

Finally, the front interface part of the AP-MALDI source is firmly fixed with a high precision to the MS area around the MS gas inlet using MS interface locks (not shown in FIG. 3). MS interface locks are a part of a mass spectrometer and have different designs in different commercial mass spectrometers.

The integrated AP-MALDI source in one embodiment of the invention does not exceed 40 cm in length. Its compact and rigid design permits the operator to easily remove it from the mass spectrometer as a unit and place it back without readjustment of the optical system. This makes the integrated AP-MALDI source an interchangeable source that allows its removal and replacement with other AP ion sources.

Generalized Aspects of the Invention:

The following is a list of generalized aspects of the invention.

In one embodiment of the invention, there is provided an ion source for a spectrometer. The ion source can be an interchangeable ion source, but could also be designed to be rigorously installed with no intent to remove except for maintenance. The ion source includes an interface which mounts the ion source relative to a gas inlet of the spectrometer. The inlet has at least one gas inlet opening (i.e., one or more openings) with a characteristic opening diameter D and an inlet gas flow axis Z. The term "characteristic opening diameter" as used herein means the major dimension of the gas inlet opening, recognizing that not all openings are perfectly circular.

The ion source includes a sample holder which positions a sample in proximity to the at least one gas inlet opening, an electric voltage supply which applies a voltage between the sample holder and the gas inlet of the spectrometer, a laser which produces a laser beam capable of generating ions the sample at ambient pressure, and an optical system including one or more focusing elements which focus the laser beam into a spot of a characteristic spot diameter d on or within the sample. The generated ions are collected into the gas inlet of the spectrometer. The term "characteristic spot diameter" as used herein means the major dimension of the spot on the sample, recognizing that not all spots are perfectly circular.

In this embodiment, the spot diameter d is smaller than the diameter D of the gas inlet opening, where the ratio d/D is less than 1. In this embodiment, the spot diameter d has a deviation δ from the inlet axis Z (as defined in FIG. 2) which is smaller than the diameter D such that a ratio δ/D is less than 1.

In this embodiment, the ion source includes an equipment chassis which supports the interface, the sample holder, the laser and the optical system as a rigid unit such that the interface, the sample holder, the laser and the optical system remain in alignment upon attachment and detachment of the ion source from the spectrometer. The term "rigid unit" in the context of this invention means that the components are held on the optical axis such that any movement of the equipment chassis also moves the components mounted to the equipment chassis in unison so that movement of the equipment chassis does not perturb the positions and alignments of the optical components therein. Given the weight and positional configuration of the optical components therein, standard engineering practices would be followed such that any displacement of the optical components therein would not compromise the optical functions. Moreover, in one embodiment, the rigid unit avoids the need to readjust the optical system upon detachment from of the ion source and reattachment of the ion source to the mass spectrometer.

The ion source includes an enclosure which generally embraces an atmosphere around at least part of the interface, at least part of the sample holder, at least part of the optical system, at least part of the laser; and at least part of the chassis. The term "generally embraces" in the context of this invention means that the atmosphere of the enclosure fills about the components inside the enclosure in a manner which does not, from the movement of the atmosphere, perturb the positions and alignments of the optical components therein and allows effective motion of the atmosphere from one part of the enclosure to another in order to reduce thermal gradients within the enclosure. The ion source includes a circulator which circulates at least part of said atmosphere within said enclosure.

In one embodiment of the ion source, the optical system comprises adjustable optical components for changing the spot diameter d and adjusting the deviation δ. In one embodiment of the ion source, the electric voltage supply is controlled (or programmed) to apply the voltage between the sample holder and the gas inlet of the spectrometer at least during a collection time after ions are generated from the laser beam. In this embodiment, the electric voltage supply is controlled (or programmed) to continuously apply the voltage between the sample holder and the gas inlet of the spectrometer during ionization of the sample. In one embodiment of the ion source, the optical system comprises an adjustable optical element including at least one of a mirror, a lens, a laser energy attenuator, a translational stage, and/or a kinematic stage.

In one embodiment of the ion source, the equipment chassis supports the optical system sufficiently so that readjustment of the optical system is not required upon detachment from of the ion source and reattachment of the ion source to the mass spectrometer.

In one embodiment of the ion source, the ratio d/D is less than 1, less than 0.3, or less than 0.1. In one embodiment of the ion source, the ratio δ/D is less than 1, less than 0.3, or less than 0.1.

In one embodiment of the ion source, the ion source is connected to at least one of a mass spectrometer and an ion mobility spectrometer. In one embodiment of the ion source, the ion source includes the sample by which imaging can occur, and the sample includes at least one of biomolecule, protein, peptide, polymer molecule, small chemical molecule, and/or biological tissue.

In one embodiment of the ion source, the enclosure has an atmosphere preferably at a pressure in the range from 0.1 Torr to 2,000 Torr. Pressures outside this range are also possible. The laser has a wavelength at least in one of an infrared wavelength range, a visible wavelength range, and an ultraviolet wavelength range. The laser has a firing frequency preferably higher than 5,000 Hz. Frequencies for example from 1,000 Hz to 50,000 Hz may be used.

In one embodiment of the ion source, the laser ionizes the sample by at least one of matrix-assisted laser desorption/ionization (MALDI) and/or direct laser ionization. In one embodiment of the ion source, the sample holder includes at least one translational stage, preferably two X and Y translational stages, for moving the sample around the spot, thereby permitting imaging of the sample's contents by selective ionization of material from the spot region followed by mass analysis of the ionized constituents. In this embodiment, the diameter d is the range from 0.3 μm to 500 μm or preferably from 3 μm to 5 μm. Other spot sizes are acceptable.

In one embodiment of the ion source, the equipment chassis is a part of the enclosure. In one embodiment of the ion source, the equipment chassis is made of a material having a low thermal expansion coefficient, such as less than $10\times10^{-6}$/K or less than $1\times10^{-6}$/K.

In one embodiment of the ion source, included therein is at least one of a laser control electronics, a translational stage control electronics, a laser energy attenuator control electronics, a camera for visual sample monitoring, and a sample illumination system. In this embodiment, the enclosure encloses at least one of the laser control electronics, the translational stage control electronics, the laser energy attenuator control electronics, the camera, and the sample illumination system. In this embodiment, an Ethernet network interconnects at least one of the laser energy attenuator control electronics, the laser control electronics, the translational stage control electronics and the camera.

In one embodiment of the ion source, the equipment chassis, the interface, the optical system, the laser, and the enclosure all together have less than a 2.0 m dimension in all directions. In one embodiment of the ion source, the equipment chassis, the interface, the optical system, the laser, and the enclosure all together have less than a 1.0 m dimension in all directions. In one embodiment of the ion source, the equipment chassis, the interface, the optical system, the laser, and the enclosure all together have less than a 0.5 m dimension in all directions.

In one embodiment of the ion source, the circulator comprises at least one of a fan and an external gas supply to circulate the atmosphere inside the enclosure. In one embodiment of the ion source, the circulator is configured to move the atmosphere in or out the enclosure at a rate which thermally stabilizes components of the optical system at a controlled temperature. In one embodiment of the ion source, the circulator is configured to circulate the atmosphere inside the enclosure across the gas inlet axis Z.

Additional modifications and variations of the present invention are possible in light of the above teachings. It is therefore to be understood that within the scope of the appended claims, the invention may be practiced otherwise than as specifically described herein.

The invention claimed is:

1. An interchangeable ion source for a spectrometer, comprising:

an interface which mounts the ion source relative to a gas inlet of the spectrometer, said inlet having at least one gas inlet opening with a characteristic opening diameter D and an inlet gas flow axis Z;

a sample holder which positions a sample in proximity to the at least one gas inlet opening;

an electric voltage supply which applies a voltage between the sample holder and the gas inlet of the spectrometer;

a laser which produces a laser beam capable of generating ions from the sample at ambient pressure, said ions being collected into said at least one gas inlet;

an optical system including one or more focusing elements which focus said laser beam into a spot of a characteristic spot diameter d on or within said sample;

said spot diameter d being smaller than said opening diameter D of the gas inlet opening, where the ratio d/D is less than 1;

said spot having a deviation δ from the inlet axis Z which is smaller than said opening diameter D such that a ratio δ/D is less than 1;

an equipment chassis which supports the interface, the sample holder, the laser and the optical system as a rigid unit such that the interface, the sample holder, the laser and the optical system remain in alignment upon attachment and detachment of the ion source from the spectrometer;

an enclosure which generally embraces an atmosphere around at least part of said interface, at least part of said sample holder, at least part of said optical system, at least part of said laser, and at least part of said chassis; and a circulator which circulates at least part of said atmosphere within said enclosure.

2. The ion source of claim 1, wherein the optical system comprises adjustable optical components for changing said spot diameter d and adjusting said deviation δ.

3. The ion source of claim 1, wherein the electric voltage supply is controlled to apply the voltage between the sample holder and the gas inlet of the spectrometer at least during a collection time after ions are generated from said laser beam.

4. The ion source of claim 3, wherein the electric voltage supply is controlled to continuously apply said voltage between the sample holder and the gas inlet of the spectrometer during said ionization of the sample.

5. The ion source of claim 1, wherein the equipment chassis supports the optical system sufficiently so that readjustment of the optical system is not required upon detachment from of the ion source and reattachment of the ion source to the mass spectrometer.

6. The ion source of claim 1, wherein the ratio d/D is less than 0.3.

7. The ion source of claim 1, wherein the ratio d/D is less than 0.1.

8. The ion source of claim 1, wherein the ratio δ/D is less than 0.3.

9. The ion source of claim 1, wherein the ratio δ/D is less than 0.1.

10. The ion source of claim 1, further comprising said sample, and said sample includes at least one of biomolecule, protein, peptide, polymer molecule, small chemical molecule, and biological tissue.

11. The ion source of claim 1, wherein the enclosure has said atmosphere at a pressure in the range from 0.1 Torr to 2,000 Torr.

12. The ion source of claim 1, wherein said laser has a wavelength at least in one of an infrared wavelength range, a visible wavelength range, and an ultraviolet wavelength range.

13. The ion source of claim 1, wherein the laser has a firing frequency higher than 5,000 Hz.

14. The ion source of claim 1, wherein said laser beam generates ions from the sample by at least one of matrix-assisted laser desorption/ionization (MALDI), direct laser ionization (DLI), nanostructure-assisted laser desorption/ionization (NALDI), surface-enhanced laser/desorption ionization (SELDI), and desorption/ionization on silicon (DIOS).

15. The ion source of claim 1, wherein the sample holder includes at least one sample translational stage for moving the sample around said spot.

16. The ion source of claim 1, wherein the diameter d is the range from 0.3 μm to 500 μm.

17. The ion source of claim 9, wherein the diameter d is the range from 0.3 μm to 5 μm.

18. The ion source of claim 1, wherein said equipment chassis is a part of said enclosure.

19. The ion source of claim 1, wherein said equipment chassis is made of a material having low thermal expansion coefficient.

20. The ion source of claim 15, wherein said optical system in addition comprises optical components including at least one of a mirror, a lens, a laser energy attenuator, an optical translational stage, and a kinematic stage.

21. The ion source of claim 20, wherein said optical system comprises an adjustable optical element including at least one of a mirror, a lens, a laser energy attenuator, an optical translational stage, and a kinematic stage.

22. The ion source of claim 20, further comprising at least one of a laser control electronics, a sample translational stage control electronics, an optical translational stage control electronics, a laser energy attenuator control electronics, a camera for visual sample monitoring, and a sample illumination system.

23. The ion source of claim 22, wherein said enclosure in addition embraces an atmosphere around at least one of the laser control electronics, the sample translational stage control electronics, the optical translational stage control electronics, the laser energy attenuator control electronics, the camera, and the sample illumination system.

24. The ion source of claim 22, further comprising an Ethernet network interconnecting at least one of the laser energy attenuator control electronics, the laser control electronics, the translational stage control electronics and the camera.

25. The ion source of claim 1, wherein the equipment chassis, the interface, the optical system, the laser, and the enclosure all together have less than a 0.5 m dimension in all directions.

26. The ion source of claim 1, wherein the circulator comprises at least one of a fan and an external gas supply to circulate the atmosphere inside the enclosure.

27. The ion source of claim 1, wherein the circulator is configured to move the atmosphere in or out the enclosure.

28. The ion source of claim 20, wherein the circulator is configured to move the atmosphere in or out the enclosure at a rate which thermally stabilizes components of the optical system at a controlled temperature.

29. The ion source of claim 1, wherein the circulator is configured to circulate the atmosphere generally across the gas inlet axis Z.

30. The ion source of claim 1, further comprising the spectrometer, wherein the spectrometer includes at least one of a mass spectrometer and an ion mobility spectrometer.

* * * * *